US007156242B2

(12) United States Patent
Lin

(10) Patent No.: US 7,156,242 B2
(45) Date of Patent: Jan. 2, 2007

(54) GARDEN TOOL RACK

(75) Inventor: Pei-Ying Lin, Taichung Hsien (TW)

(73) Assignee: Global Industries Holdings Ltd., Northfield, IL (US)

( * ) Notice: Subject to any disclaimer, the term of this patent is extended or adjusted under 35 U.S.C. 154(b) by 410 days.

(21) Appl. No.: 10/857,213

(22) Filed: May 28, 2004

(65) Prior Publication Data

US 2005/0184014 A1 Aug. 25, 2005

(30) Foreign Application Priority Data

Feb. 19, 2004 (CN) ..... 93202378 U

(51) Int. Cl.
*A47F 7/00* (2006.01)

(52) U.S. Cl. ..... 211/70.6

(58) Field of Classification Search ..... 211/70.6, 211/60.1; 248/156, 530; 206/373; D8/11
See application file for complete search history.

(56) References Cited

U.S. PATENT DOCUMENTS

| | | | | |
|---|---|---|---|---|
| 5,390,944 | A * | 2/1995 | Sherwin | 280/47.35 |
| 6,213,314 | B1 * | 4/2001 | Beemer | 211/70.6 |
| 6,530,487 | B1 * | 3/2003 | Berry | 211/70.6 |
| 6,848,587 | B1 * | 2/2005 | Chao | 211/70.6 |
| 7,040,493 | B1 * | 5/2006 | Lin | 211/70.6 |

* cited by examiner

*Primary Examiner*—Sarah Purol
(74) *Attorney, Agent, or Firm*—Levenfeld Pearlstein, LLC

(57) ABSTRACT

A garden tool rack includes a hollow rack body, tool holders plugged into respective plugholes in the rack body for holding garden tools, axial positioning structures adapted to stop the tool holders from axial displacement relative to the rack body, rotary positioning structures adapted to let the tool holders be biased relative to the rack body within a limited angle and then locked in position to prevent interference of loaded garden tools with one another.

16 Claims, 7 Drawing Sheets

GARDEN TOOL RACK

BACKGROUND OF THE INVENTION

1. Field of the Invention

The present invention relates to a garden tool rack and, more particularly to such a garden tool rack, which is practical for use to hold a set of garden tools when working in a garden.

2. Description of the Related Art

For cultivation of soil and taking care of a garden, a variety of garden tools may be used. Regular garden tools include dibble, rack, digging fork, mattock draw hoe, shears, hedge trimmers, garden trowel, cultivator, etc. These garden tools have different shapes and sizes for different purposes. When gardening, garden tools may be scattered over the ground, and the scattered garden tools may injure people accidentally. Further, it is inconvenient to carry a set of garden tools to the jobsite. After gardening, the user must spend a lot of time to collect the scattered garden tools.

SUMMARY OF THE INVENTION

The present invention has been accomplished under the circumstances in view. It is the main object of the present invention to provide a garden tool rack, which is convenient for use to hold a set of garden tools on soil when working. It is another object of the present invention to provide a garden tool rack, which prevents interference of loaded garden tools with one another, for enabling the user to conveniently use garden tools.

To achieve these and other objects of the present invention, the garden tool rack comprises a rack body, the rack body comprising a plurality of plugholes vertically extended through top and bottom walls thereof and a plurality of bottom barrels respectively downwardly extended from the bottom wall around each the plughole; a plurality of tool holders respectively axially fastened to the plugholes of the rack body for holding garden tools; a plurality of end caps respectively fastened to the bottom barrels of the rack body; and a plurality of anchoring devices respectively coupled to the end caps and adapted for fastening the rack body to earth. The garden tool rack further comprises a plurality of axial positioning structures adapted to stop the tool holders from axial movement relative to the plugholes of the rack body after insertion of the tool holders into the plugholes of the rack body, and a plurality of rotary positioning structures adapted to stop the tool holders from rotary motion relative to the plugholes of the rack body after insertion of the tool holders into the plugholes of the rack body.

DETAILED DESCRIPTION OF THE PREFERRED EMBODIMENT

Figure 1:
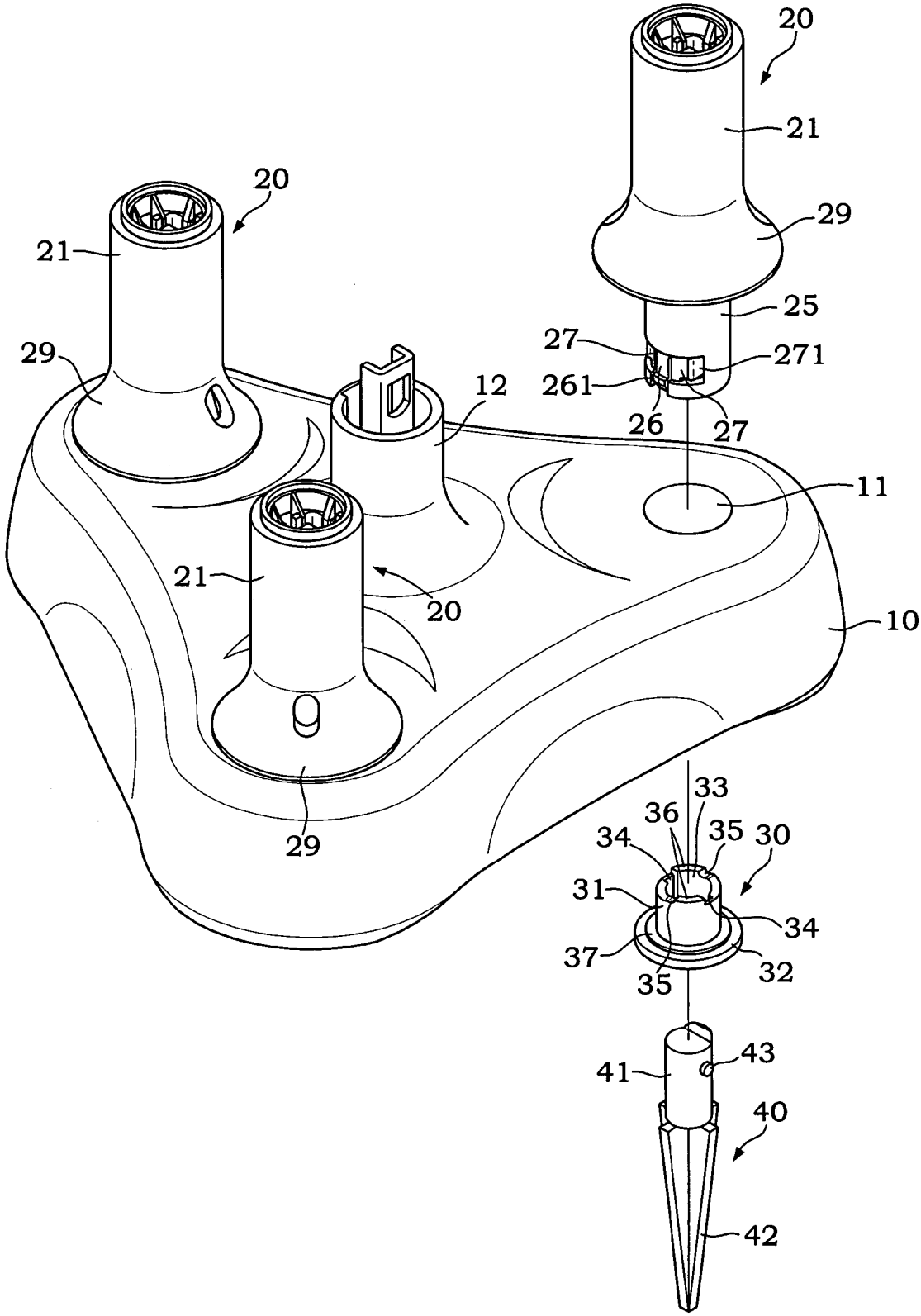
FIG. 1 is an exploded view of a garden tool rack according to the present invention.
Figure 2:
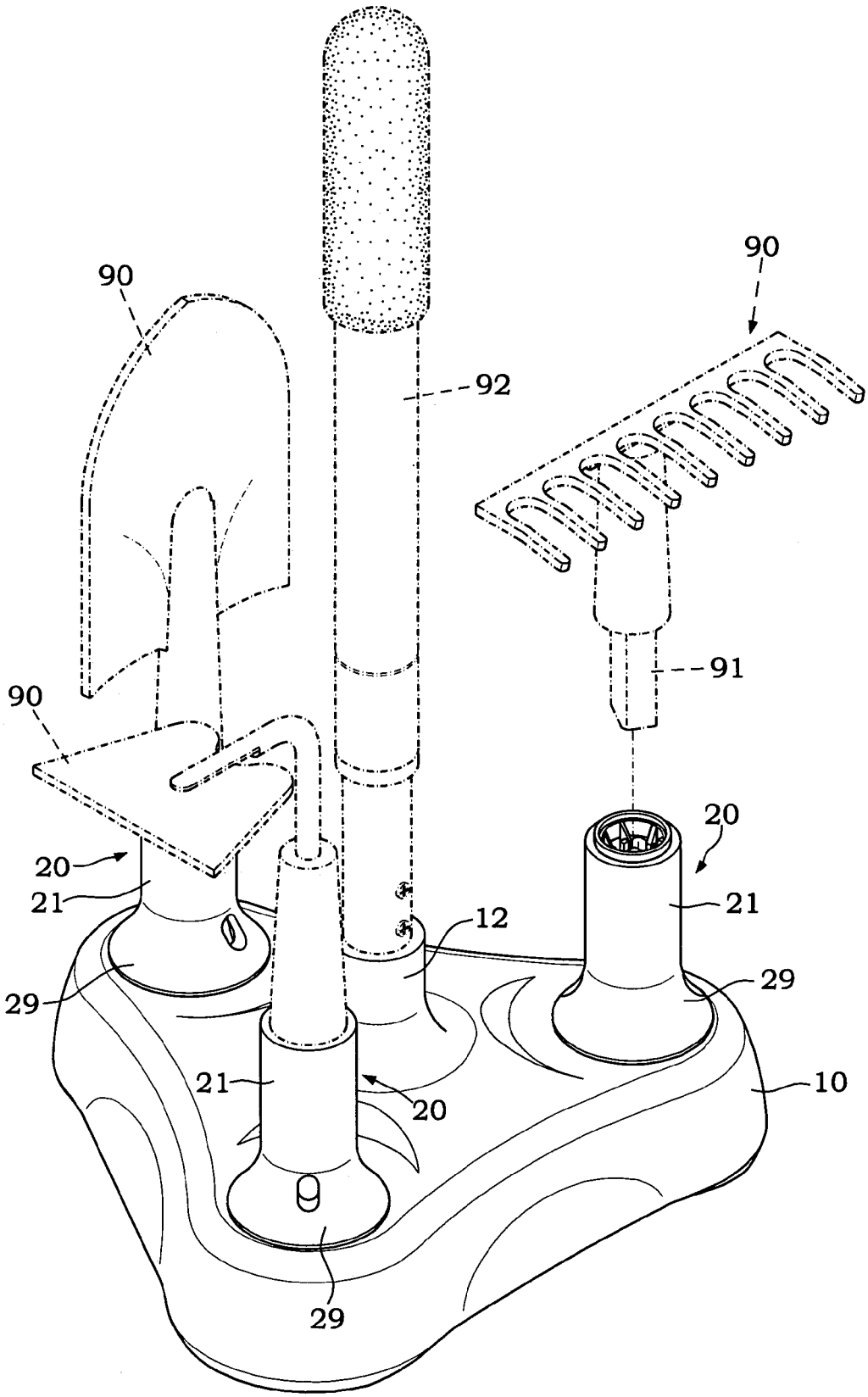
FIG. 2 is an oblique top elevation of the garden tool rack according to the present invention.
Figure 3:
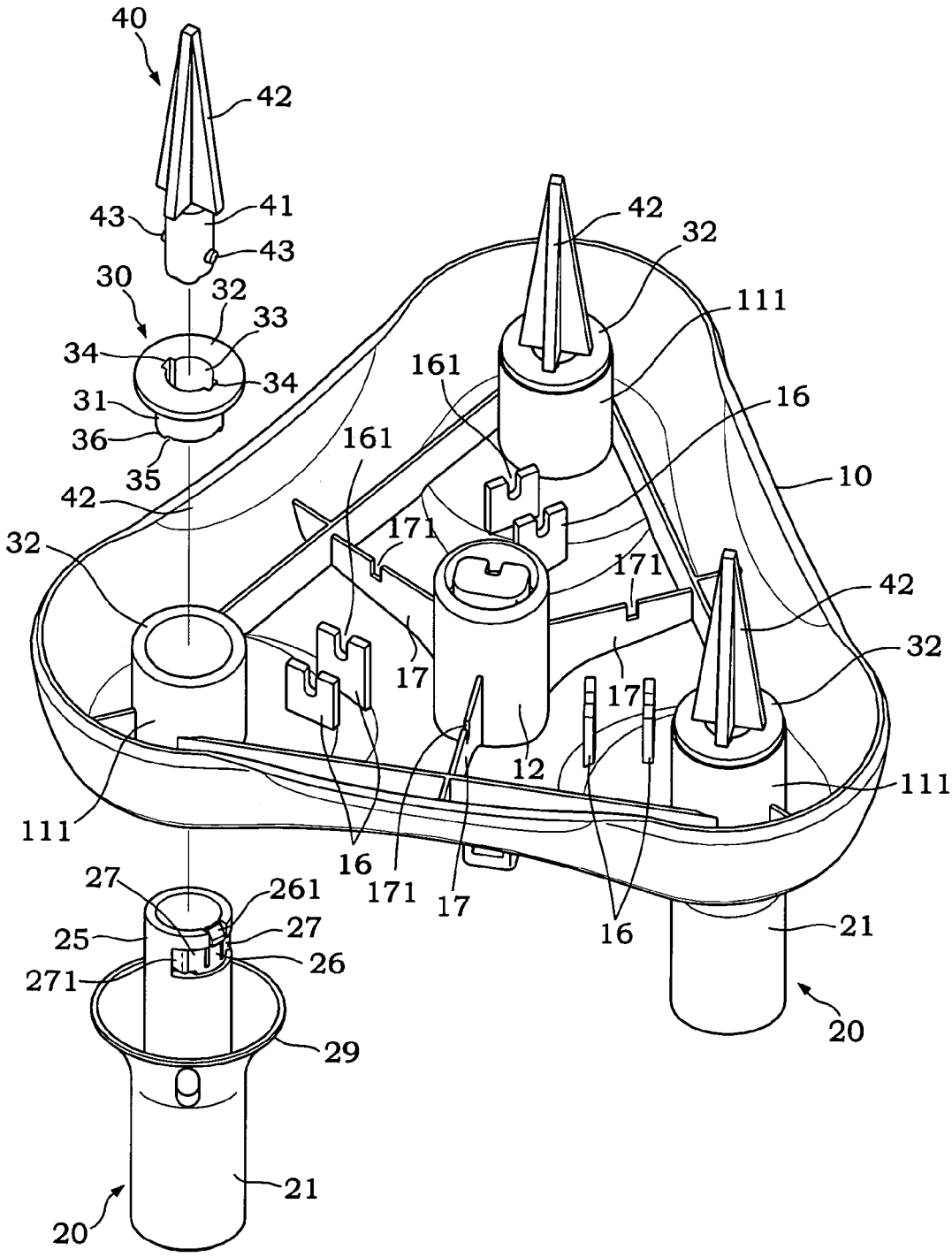
FIG. 3 is an exploded bottom view of the garden tool rack according to the present invention.

Referring to FIGS. 1~3, a garden tool rack in accordance with the present invention is shown comprised of a rack body 10, a plurality of hollow cylindrical tool holders 20, a plurality of plug caps 30, and a plurality of anchoring devices 40.

Referring to FIGS. 1 and 2 again, the rack body 10 is a hollow shell molded from plastics, comprising a vertical barrel 12 vertically disposed at the center for holding a tool handle 92, a plurality of plug holes 11 spaced around the vertical barrel 12, and a plurality of bottom barrels 111 downwardly extended from the bottom wall corresponding to the plug holes 11.

Referring to FIGS. 1~3 again, the tool holders 20 are respectively fastened to the plug holes 11 and adapted to hold a respective garden tool 90, each comprising a top holder body 21 for receiving the tool shaft 91 of a garden tool 90, a bottom mounting tube 25 for insertion into one plughole 11 of the rack body 10, and a skirt-like shoulder 29 provided between the top holder body 21 and the bottom mounting tube 25 and adapted to support the top holder body 21 above the top wall of the rack body 10. The bottom mounting tube 25 is insertable through one plughole 11 into the corresponding bottom barrel 111.

Figure 6:
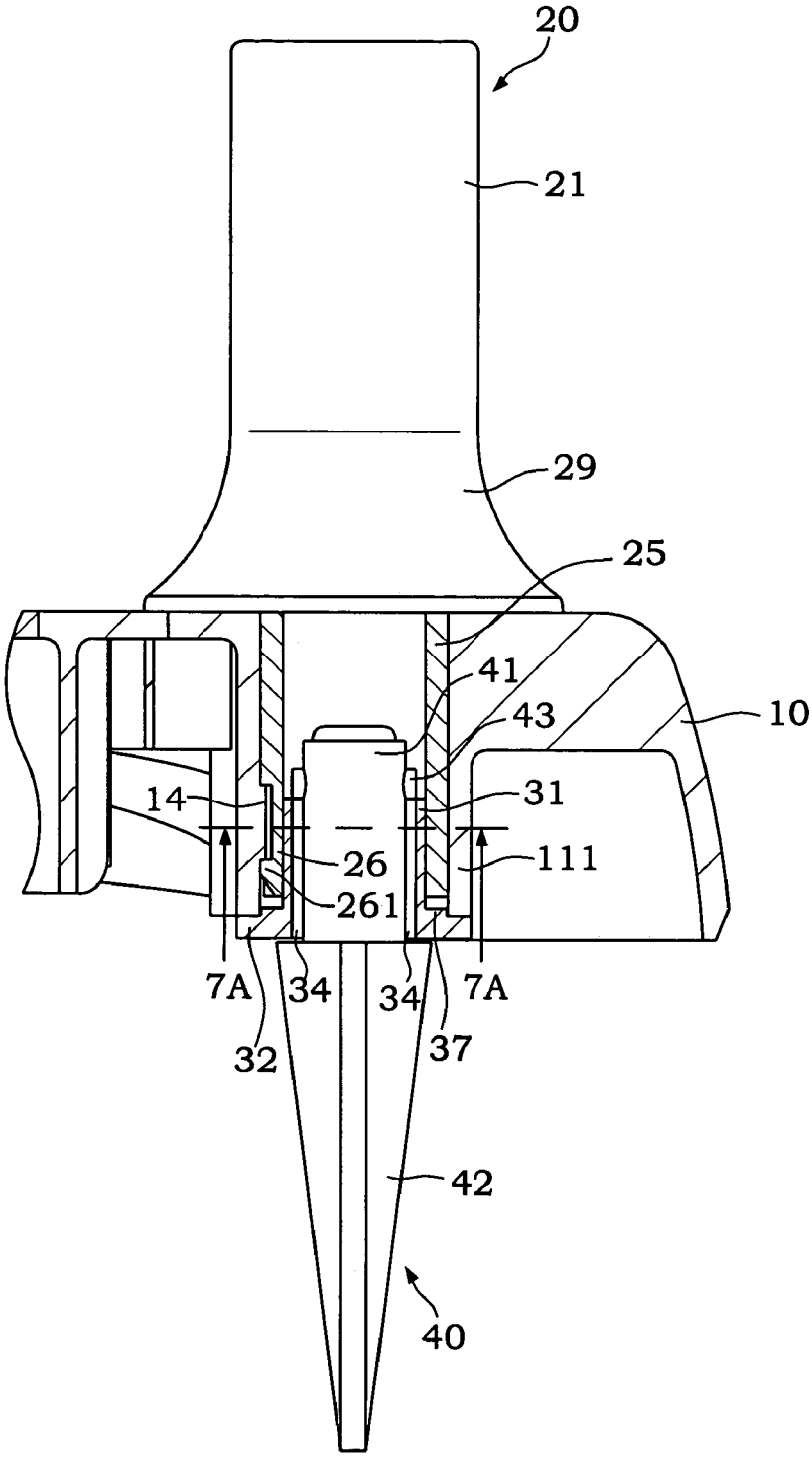
FIG. 6 is a sectional view in an enlarged scale of a part of the present invention, showing the anchoring device fastened to the respective end cap.
Figure 7A:
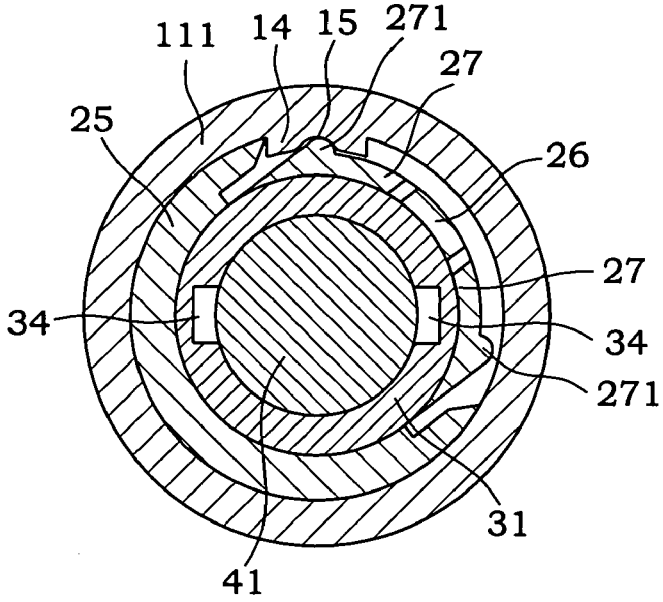
FIG. 7A is a sectional view taken along line 7A—7A of FIG. 4.
Figure 7B:
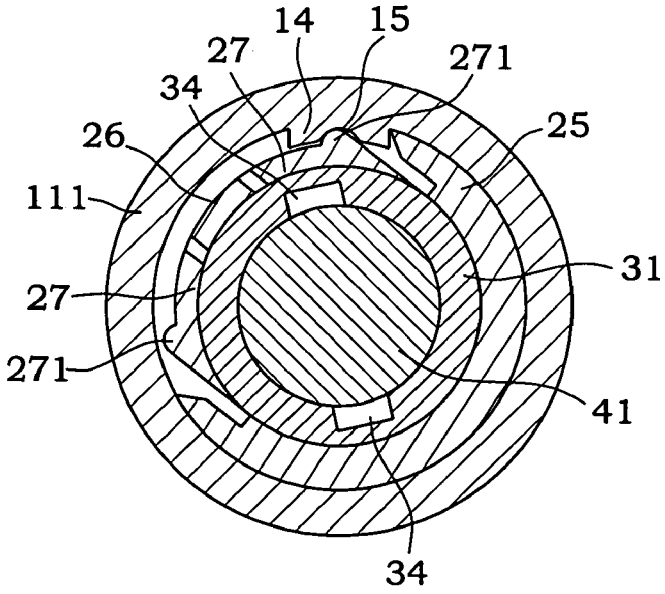
FIG. 7B is similar to FIG. 7A but showing one horizontal spring leave engaged into the longitudinal groove in the inside protruding block.

Referring to FIGS. 6, 7A and 7B, and FIG. 1 again, each bottom barrel 111 of the rack body 10 comprises an inside protruding block 14 protruded from the inside wall, and a longitudinal groove 15 formed in the inside protruding block 14. The bottom mounting tube 25 of each tool holder 20 comprises a vertical retaining spring leaf 26, and two horizontal retaining spring leaves 27 symmetrically disposed at two sides of the vertical retaining spring leaf 26. The vertical retaining spring leaf 26 has the free end (the bottom end) terminating in a protruded retaining portion 261. Each horizontal retaining spring leaf 27 has the free end terminating in a protruded retaining portion 271. The spring leaves 26, 27 are disposed at an offset position such that a space is defined for receiving the inside protruding block 14 upon insertion of the bottom mounting tube 25 into one bottom barrel 111 of the rack body 10. When inserted the bottom mounting tube 25 into one bottom barrel 111 of the rack body 10, the protruded retaining portion 261 is forced into engagement with the bottom side of the inside protruding block 14 to stop the respective tool holder 20 from axial displacement. At this time, bias the tool holder 20 to force the protruded retaining portion 27 of one horizontal retaining spring leaf 27 into engagement with the longitudinal groove 15. At this time, a part of the bottom mounting tube 25 around one retaining spring leaf 27 is stopped against the inside protruding block 14, and therefore the tool holder 20 is prohibited from rotary motion in the same direction. Therefore, after insertion of the tool holders 20 into the plugholes 11 of the rack body 10, the tool holders 20 can be respectively biased through a limited angle, preventing interference of the loaded garden tools 90 with one another.

Figure 5A:
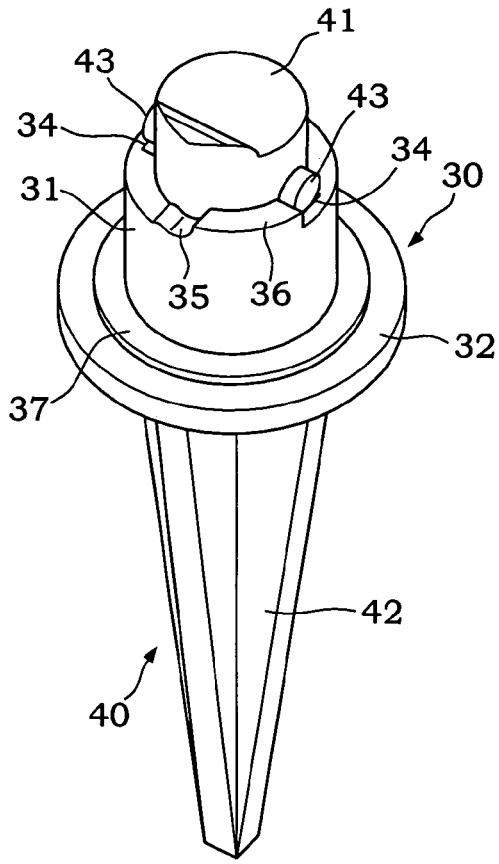
FIG. 5A illustrates the pegs of the anchoring device stopped at the locating protrusions of the respective end cap according to the present invention.
Figure 5B:
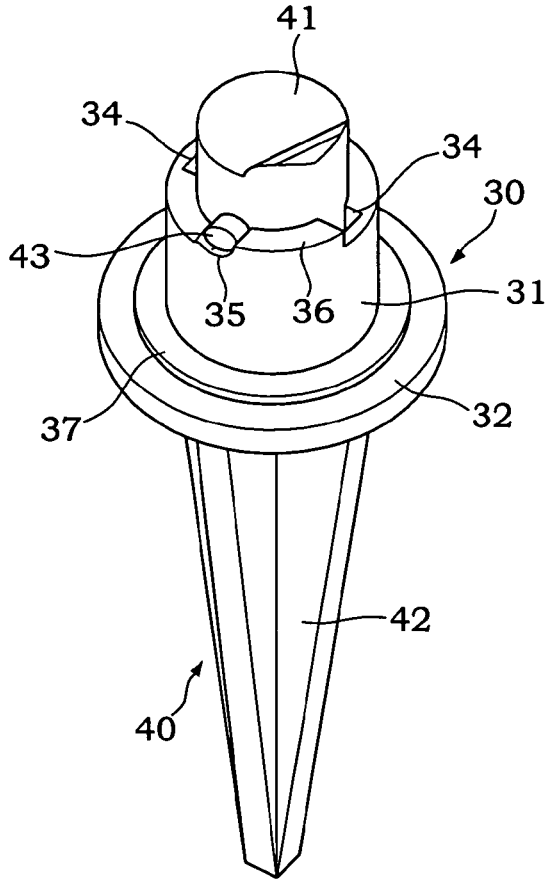
FIG. 5B is similar to FIG. 5A but showing the pegs of the anchoring device respectively engaged into the locating notches of the respective end cap.

Referring to FIGS. 5A and 5B, and FIGS. 1 and 6 again, the end caps 30 are substantially T-shaped hollow caps each comprising a cylindrical cap body 31 fitting the inner diameter of the bottom mounting tube 25, a cap head 32, a shoulder 37 connected between the cap body 31 and the cap head 32 and fitting the inner diameter of the bottom barrels 111, a center through hole 33 axially extended through the cap head 32 and the shoulder 37 and the cylindrical cap body 31, two longitudinal grooves 34 symmetrically disposed in the center through hole 33 at two sides and axially extended to the two ends of the respective end cap 30, and two locating notches 35 and two locating protrusions 36 alternatively disposed at the distal end of the cylindrical cap body 31 and equiangularly spaced from one another. Each end cap 30 has the respective shoulder 37 press-fitted into one bottom barrel 111, and the respective cylindrical cap body 31 press-fitted into the bottom mounting tube 25 of the corresponding tool holder 20, keeping the cap head 32 stopped at the bottom end of the corresponding bottom barrel 111 to hold the protruded retaining portion 261 of the vertical retaining spring leaf 26 of the respective tool holder 25 firmly in engagement with the bottom side of the respective inside protruding block 14, and therefore the respective tool holder 20 is locked to the rack body 10.

Referring to FIGS. 1, 3, 5A, 5B and 6 again, each anchoring device 40 comprises a cylindrical base 41, an anchoring tip 42 axially extended from one end of the cylindrical base 21, and two pegs 43 radially protruded from the periphery of the cylindrical base 21 at two sides. When inserting the cylindrical base 41 into the center through hole 33 of one end cap 30, the pegs 43 are respectively inserted into the longitudinal grooves 34. After the cylindrical base 41 has been completely inserted into the end cap 30, the pegs 43 are respectively stopped against the locating protrusions 36 at one side outside the longitudinal grooves 34. At this time, the anchoring device 40 is biased in one direction through an angle to force the pegs 43 into the locating notches 35, and therefore the anchoring device 40 is locked to the respective end cap 30. On the contrary, when biasing the anchoring device 40 in the reversed direction, the pegs 43 are moved out of the locating notches 35 to the longitudinal grooves 34, and therefore the anchoring device 40 is unlocked and can be removed from the respective end cap 30.

Figure 4:
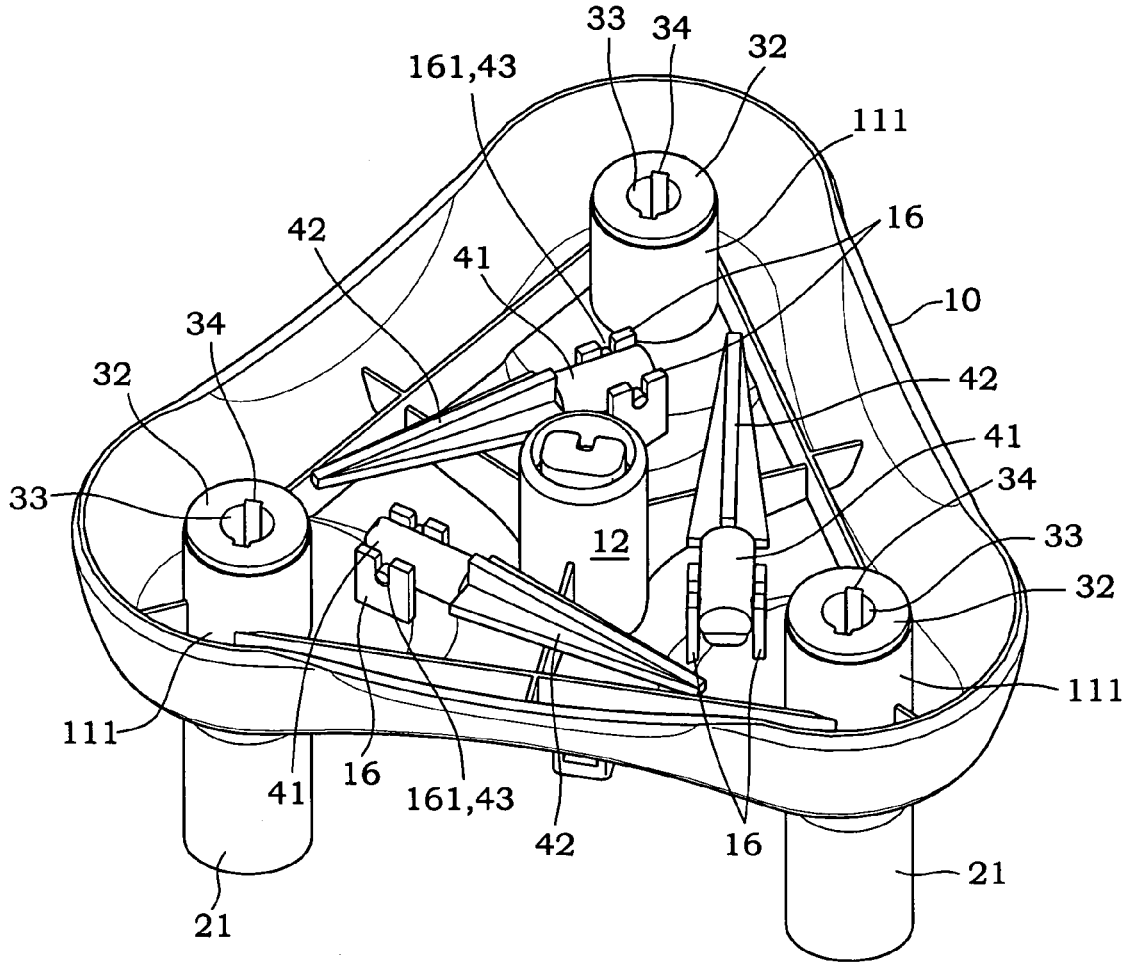
FIG. 4 is similar to FIG. 3 but showing the anchoring devices respectively received in the anchoring device receiving structures.

Referring to FIGS. 3 and 4 again, there is provided a plurality of receiving structures adapted to receive the anchoring devices 40 in the bottom side of the rack body 10 after removal of the anchoring devices 40 from the end caps 30. Each receiving structure comprises a pair of lugs 16 downwardly extended from the bottom side of the rack body 10, and a rib 17 radially extended from the periphery of the vertical barrel 12 at the bottom side of the rack body. The lugs 16 each have a bottom notch 161. The rib 17 has a bottom notch 171. After removable of one anchoring device 40 from the respective end cap 30, the anchoring device 40 is fastened to one receiving structure in such a manner that the cylindrical base 41 is set in between the lugs 16 with pegs 43 respectively engaged into the bottom notches 161 of the lugs 16 and the anchoring tip 42 engaged into in the bottom notch 171 of the rib 17.

As indicated above, garden tools 90 can be respectively plugged into the tool holders 20 at the rack body 10. Plugging garden tools 90 into the tool holders 20 or removing garden tools 90 from the tool holders 20 does not cause axial displacement of the tool holders 20 relative to the rack body 10. After insertion of garden tools 90 into one tool holders 20, the loaded garden tools 90 can be respectively biased with the respective tool holders 90 relative to the rack body 10 within a limited angle to prevent interference of loaded garden tools 90 with one another. When in use, the anchoring devices 40 can be respectively plugged into the end caps 30 for fastening the rack body 10 to earth, keeping the rack body 10 firmly supported on earth. When not in use, the garden tool rack is removed from earth. Because the end caps 30 are respectively locked to the bottom barrels 111 of the rack body 10, pulling the garden tool rack away from earth does not cause the end caps 30 to fall with the anchoring devices 40 from the rack body 10. After removal of the garden tool rack from earth, the anchoring devices 40 are unlocked and detached from the end caps 30 and then respectively received in the respective receiving structures at the bottom side of the rack body 10.

A prototype of garden tool rack has been constructed with the features of FIGS. 1~7. The garden tool rack functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A garden tool rack comprising:

a rack body, said rack body comprising a plurality of plugholes vertically extended through top and bottom walls thereof and a plurality of bottom barrels respectively downwardly extended from the bottom wall around each said plughole;

a plurality of tool holders respectively axially fastened to the plugholes of said rack body for holding garden tools;

a plurality of end caps respectively fastened to the bottom barrels of said rack body; and a plurality of anchoring devices respectively coupled to said end caps and adapted for fastening said rack body to earth.

2. The garden tool rack as claimed in claim 1, wherein each said end cap comprises a cylindrical cap body fitted into one said tool holder, a cap head stopped outside one said bottom barrel of said rack body, and a shoulder connected between said cap body and fitted into one said bottom barrel of said rack body.

3. The garden tool rack as claimed in claim 1, wherein said anchoring devices each comprise a cylindrical base connectable to one said end cap, and an anchoring tip axially extended from one end of said cylindrical base for fastening to earth.

4. The garden tool rack as claimed in claim 3, wherein each said end cap comprises an axially extended center through hole adapted to receive the cylindrical base of one said anchoring device, and at least one longitudinal groove formed in said axially extended center through hole and axially extended through two distal ends of said axially extended center through hole; each said anchoring device comprises at least one peg perpendicularly extended from the cylindrical base thereof for insertion through the at least one longitudinal groove and stoppage at one end of the respective end cap after insertion of said at least one peg through said at least one longitudinal groove.

5. The garden tool rack as claimed in claim 4, wherein each said end cap further comprises at least one locating notch at one end of the cylindrical cap body thereof for receiving the at least one peg of one said anchoring device.

6. The garden tool rack as claimed in claim 5, wherein each said end cap comprises at least one locating protrusion respectively suspended between one of said at least one locating notch and one end of one of said longitudinal groove.

7. The garden tool rack as claimed in claim 4, further comprising a plurality of anchoring device receiving structures provided at the bottom wall of said rack body and adapted to receive said anchoring devices after removal of said anchoring devices from said end caps.

8. The garden tool rack as claimed in claim 7, wherein each said anchoring device receiving structure comprises a pair of lugs downwardly extended from the bottom wall of said rack body for receiving the cylindrical base of one said anchoring device between said lugs, said lugs each having a locating notch adapted to accommodate the at least one peg of one said anchoring device.

9. The garden tool rack as claimed in claim 8, wherein each said anchoring device receiving structure further comprises a rib radially provided at the bottom wall of said rack body, said rib comprising a locating notch adapted to hold the anchoring tip of one said anchoring device.

10. The garden tool rack as claimed in claim 1, further comprising a plurality of axial positioning structures adapted to stop said tool holders from axial movement relative to said plugholes of said rack body after insertion of said tool holders into said plugholes of said rack body.

11. The garden tool rack as claimed in claim 10, wherein each said axial positioning structure comprises an inside protruding block protruded from an inside wall of one said bottom barrel of said rack body, and a vertical retaining spring leaf suspended from one said tool holder and adapted to hook on a bottom side of the inside protruding block at one said bottom barrel of said rack body.

12. The garden tool rack as claimed in claim 11, further comprising a plurality of rotary positioning structures adapted to stop said tool holders from rotary motion relative to said plugholes of said rack body after insertion of said tool holders into said plugholes of said rack body.

13. The garden tool rack as claimed in claim 12, wherein each said rotary positioning structure comprises one longitudinal groove formed in the inside protruding block inside one said bottom barrel of said rack body, and at least one horizontal spring leaf transversely suspended from one said tool holder and adapted to engage the longitudinal groove in the inside protruding block inside one said bottom barrel of said rack body.

14. The garden tool rack as claimed in claim 1, wherein said rack body further comprises a vertical barrel vertically disposed at the center thereof for holding a tool handle.

15. The garden tool rack as claimed in claim 1, wherein each said tool holder comprises a top holder body for receiving a garden tool, and a bottom mounting tube axially extended from one end of said top holder body for insertion into one plughole of said rack body.

16. The garden tool rack as claimed in claim 15, wherein each said tool holder further comprises a skirt-like shoulder provided between said top holder body and said bottom mounting tube and adapted to support said top holder body above the top wall of said rack body.

* * * * *